US011375325B2

(12) United States Patent
Froehlich et al.

(10) Patent No.: US 11,375,325 B2
(45) Date of Patent: Jun. 28, 2022

(54) METHOD FOR OPERATING A HEARING DEVICE, AND HEARING DEVICE

(71) Applicant: Sivantos Pte. Ltd., Singapore (SG)

(72) Inventors: Matthias Froehlich, Erlangen (DE); Gerard Loosschilder, JD Amersfoort (NL)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 17/072,453

(22) Filed: Oct. 16, 2020

(65) Prior Publication Data

US 2021/0120349 A1 Apr. 22, 2021

(30) Foreign Application Priority Data

Oct. 18, 2019 (DE) ..... 102019216100

(51) Int. Cl.
*H04R 25/00* (2006.01)

(52) U.S. Cl.
CPC ..... *H04R 25/507* (2013.01); *H04R 25/70* (2013.01); *H04R 2225/39* (2013.01); *H04R 2225/41* (2013.01)

(58) Field of Classification Search
CPC ..... H04R 2225/39; H04R 2225/41; G06N 20/00; G06N 20/10; G06N 20/20
See application file for complete search history.

(56) References Cited

U.S. PATENT DOCUMENTS 7,742,612 B2 6/2010 Froehlich et al.
8,139,778 B2 3/2012 Barthel et al.
8,165,329 B2 * 4/2012 Bisgaard ..... H04R 25/305 381/314
8,477,972 B2 * 7/2013 Buhmann ..... H04R 25/70 381/312
9,167,359 B2 * 10/2015 Waldmann ..... H04R 25/70
9,191,754 B2 11/2015 Barthel et al.
9,219,965 B2 * 12/2015 Rasmussen ..... H04R 25/55
9,886,954 B1 * 2/2018 Meacham ..... G10L 21/028
(Continued)

FOREIGN PATENT DOCUMENTS

CN 104717593 A 6/2015
CN 109256122 A 1/2019
(Continued)

*Primary Examiner* — Ryan Robinson

(74) *Attorney, Agent, or Firm* — Laurence A. Greenberg; Werner H. Stemer; Ralph E. Locher

(57) ABSTRACT

A hearing device has a signal processor which has an adjustable parameter that has a given setting at a given time. The parameter is set depending on the situation by selecting a setting, depending on an environmental situation and by a learning machine. A current setting of the parameter can be rated by feedback from a user. In a first training procedure the learning machine is passively trained by negative feedback signals, by rating feedback from the user as dissatisfaction with the current setting and by assuming the user's satisfaction with the current setting as long as no feedback is given. In a second training procedure the learning machine is trained by changing the current setting independently of the feedback from the user and in spite of an assumed satisfaction with the current setting, so that the user is offered a different setting which can then be rated by feedback.

12 Claims, 2 Drawing Sheets

(56) References Cited

U.S. PATENT DOCUMENTS

| | | | | |
|---|---|---|---|---|
| 10,194,259 | B1 * | 1/2019 | Martin | G06F 3/012 |
| 10,433,075 | B2 * | 10/2019 | Crow | H04R 25/505 |
| 2008/0019547 | A1 | 1/2008 | Baechler | |
| 2011/0313315 | A1 * | 12/2011 | Attias | A61B 5/162 600/559 |
| 2014/0193008 | A1 * | 7/2014 | Zukic | H04R 25/70 381/314 |
| 2016/0302014 | A1 | 10/2016 | Fitz et al. | |
| 2018/0063653 | A1 * | 3/2018 | Aschoff | H04R 25/558 |
| 2019/0052978 | A1 | 2/2019 | Hannemann et al. | |
| 2019/0149927 | A1 * | 5/2019 | Zhang | G06F 3/165 704/271 |
| 2020/0302099 | A1 * | 9/2020 | Grenier | G06F 30/27 |
| 2021/0195343 | A1 * | 6/2021 | Aubreville | G06F 3/0482 |
| 2021/0321201 | A1 * | 10/2021 | Frieding | H04R 25/554 |

FOREIGN PATENT DOCUMENTS

| | | | |
|---|---|---|---|
| CN | 109391891 | A | 2/2019 |
| DE | 10347211 | A1 | 5/2005 |
| DE | 102013205357 | A1 | 10/2014 |
| EP | 1906700 | B1 | 1/2013 |
| EP | 2255548 | B1 | 5/2013 |

* cited by examiner

METHOD FOR OPERATING A HEARING DEVICE, AND HEARING DEVICE

CROSS-REFERENCE TO RELATED APPLICATION

This application claims the priority, under 35 U.S.C. § 119, of German patent application DE 10 2019 216 100, filed Oct. 18, 2019; the prior application is herewith incorporated by reference in its entirety.

BACKGROUND OF THE INVENTION

Field of the Invention

The invention relates to a method for operating a hearing device and to a corresponding hearing device.

A hearing device is typically used to treat a hearing-impaired user. The hearing device has a microphone which receives sound signals from the user's environment and converts them into an electrical input signal. This is modified in a signal processor of the hearing device, in particular making use of an audiogram of the user. As a result of the modification, the signal processor generates an electrical output signal which is fed to a receiver of the hearing device, which then converts the electrical output signal into an output acoustic signal and outputs it to the user.

The modification within the signal processor depends on one or more parameters, more precisely, signal processing parameters. These are each set to a specific value so that each parameter has a specific setting at a given time. The respective setting and hence the corresponding value are selected appropriately depending on the situation. To determine the situation, the hearing device has a classifier which uses the electrical input signal to determine a current situation and then sets the signal processing parameters appropriately depending on the current situation.

For example, European patent EP 2 255 548 B1, corresponding to U.S. Pat. No. 8,477,972, describes a hearing device in which a classifier extracts a plurality of features from an input signal and generates a classifier output signal which is used to adapt parameters of a transfer function for a signal processor. The classifier output signal is dependent on a weighting, which is updated by means of a feedback signal from a user. In this context, a semi-supervised learning procedure with a passive updating scheme is also described. It is assumed there that feedback is only applied if the setting of the classifier needs to be changed. If, on the other hand, no feedback is received, the current settings are retained.

BRIEF SUMMARY OF THE INVENTION

Against this background, an object of the invention is to improve the operation of a hearing device, i.e. to specify an improved method for operating a hearing device. In particular, the object is to improve the learning of the most optimal settings for the hearing device. An improved hearing device will also be specified.

The object is achieved according to the invention by a method having the features as claimed in the independent method claim and by a hearing device having the features as claimed in the independent hearing device claim. Advantageous configurations, extensions and variants form the subject matter of the dependent claims. The comments in relation to the method also apply, mutatis mutandis, to the hearing device, and vice versa. Where method steps are described in the following, advantageous configurations for the hearing device are obtained in particular by the fact that the latter is configured to execute one or more of these method steps.

The method is used for operating a hearing device, hence it is an operating method for the hearing device. The hearing device has a signal processor, which has at least one adjustable parameter that has a given setting at a given time. In particular, the setting is a specific value of the parameter, e.g. a specific gain or sound volume, or a width of a directional beam for directional hearing with the hearing device. A user of the hearing device carries it in or on the ear when the device is used as intended. The hearing device is preferably used for treating a hearing-impaired user. The hearing device preferably has at least one microphone for receiving ambient sounds, and a receiver for outputting sounds to the user. The microphone generates an electrical input signal from the ambient sounds, which is passed on to the signal processor and is then modified, e.g. amplified, by the signal processor depending on the parameter. This generates a modified input signal which is then an electrical output signal and which is forwarded to the receiver for output. Particularly in the case of a hearing-impaired user, the input signal is modified by the signal processor according to an individual audiogram, which is stored, in particular, in the hearing device. Preferably, the signal processor has a modification unit that modifies the input signal as a function of the parameter.

The parameter is set according to the situation by selecting a setting for the parameter depending on the current environment situation and using a learning machine. The parameter is preferably set recurrently depending on the situation. The situation-dependent setting of the parameter is carried out, in particular, automatically by the signal processor and as part of the operation of the hearing device. The parameter is also conveniently adjustable in other ways, e.g. manually by the user. For the situation-dependent setting, the current environment situation is first detected. This environment situation is assigned a specific setting according to an assignment rule, which is then selected so that the parameter is set accordingly. In particular, the learning machine has a classifier, by means of which the environment situation is detected. The learning machine, specifically the classifier, analyzes in particular the input signal generated by the microphone and assigns a class to the current environment situation, e.g. speech, music or noise. Depending on the class, the parameter is then set, i.e. a suitable setting is selected for the parameter. By means of the learning machine, the hearing device learns over time which setting is most suitable in which environment situation and then selects it. The particular setting is therefore not assigned statically to a particular environment situation in the present case, but is adapted dynamically by the learning machine. In other words, the assignment rule between settings and environmental situations is continuously updated by the learning machine.

A current setting of the parameter can be rated by feedback from a user of the hearing device. The current setting is the setting which is set at the current time. The user can rate this setting by providing feedback. The feedback generally contains an instruction or request from the user to the hearing device to change the current setting, i.e. to set the parameter differently. The feedback is generally provided via an input element of the hearing device, e.g. a button for manual input or a microphone for speech input, or another type of sensor for acquiring a user input. The user expresses their satisfaction with the current setting via the feedback. A rating is then assigned to a particular setting of the parameter, e.g. in the form of a counter. The rating is then changed depending on the feedback and thus generally indicates the satisfaction of the user with this setting. Typically, as described above, the setting is assigned to a specific class and therefore to a specific environment situation, so that the rating indicates the user's satisfaction with this setting for the associated environment situation. In principle, it is possible that multiple different settings are assigned to a single class, or that multiple different classes are assigned to a single setting, or both. Thus, a single setting can receive and include different ratings for multiple classes.

As part of the method, in a first training procedure the learning machine is passively trained using negative feedback signals, by treating feedback from the user as dissatisfaction with the current setting and by assuming the user to be satisfied with the current setting as long as no feedback is given. The method therefore contains a learning procedure for the learning machine. The first training procedure is a passive one. This means that during the first training procedure, feedback from the user is not explicitly elicited or requested, but that voluntarily given feedback from the user is used. Instead of actively asking the user about their satisfaction with a setting, this satisfaction is derived from the behavior of the user. If the user provides feedback, it is assumed that the setting at the time of the feedback is not satisfactory and that the feedback has therefore been provided. On the other hand, in the absence of feedback, it is assumed that the current setting is satisfactory.

As part of the method, in addition to the first training procedure the learning machine is additionally trained in a second training procedure by changing the current setting independently of feedback from the user and in spite of an assumed satisfaction with the current setting, so that the user is offered a different setting which can then be rated by feedback. Based on the first, passive training procedure, the user is thus offered different settings unprompted in order to obtain additional ratings for these settings, even though the current setting itself is considered satisfactory. In particular, in the second training procedure the current setting of the parameter is changed with a constant environment situation in order to test different settings for the same environment situation. In the course of the method, therefore, different settings are tested experimentally, so that the second training is also referred to as experimentation-based training. The learning machine experiments with settings different to the current setting that was already assumed to be satisfactory, by discarding this current setting despite its assumed satisfaction in order to test another setting.

What initiates the change in the setting in the second training procedure is not important initially. However, a suitable configuration is one in which the current setting is changed in the second training procedure if no automatic or no manual change is made over a certain period of time, or neither. Preferably, the current setting is changed if no situation-dependent change has taken place over a certain period of time. The time period is generally preferably between 5 minutes and 15 minutes. Alternatively or in addition, in an advantageous embodiment the current setting is changed in the second training procedure if the current setting is rated as satisfactory.

The invention is based primarily on the observation that active training of the learning machine is usually annoying for the user, as it requires regular feedback, possibly even without the user being able to determine the time at which it is given. Under certain circumstances, even using the hearing device may be a negative emotional experience for the user. In an active training procedure, the user is offered different settings which the user should then rate by means of a corresponding feedback. By contrast, passive training of the learning machine, in which such active feedback is not elicited, is much more advantageous. Such a passive training shows a significantly higher acceptance during the normal use of the hearing device. However, an active training, in which the user is actively consulted, has the advantage that more feedback is typically available and can also be generated as required, so that satisfactory settings are learned by the learning machine much faster than in a passive training procedure.

A very particular advantage is obtained from the combination of the first, passive training with the second, experimentation-based training, which results in faster learning overall than with passive training alone. The experimentation-based training will potentially provoke additional feedback responses and thus potentially generate additional ratings, but the advantage of a passive training is retained, namely the reduced user interaction compared to active training. Instead, during the second training procedure the mechanism of the first training procedure is essentially retained and used to check whether a different setting to the original is still satisfactory to the user by deliberately changing the setting. This different setting is then fed in during operation unprompted, so to speak, and as an alternative to the current setting. By means of the second training procedure, an enlarged range of values for the parameter is made accessible to a passive rating by the user. Overall, this means that the convergence of the overall system, particularly the learning machine, toward the most optimal settings for the respective user is significantly accelerated. The learning of optimal settings is thus accelerated and correspondingly improved.

The terms "first training procedure" and "second training procedure" are used in this context to clarify the two levels of learning in a preferred design of the learning machine, namely the inherently simple passive training on the one hand and the experimentation and training of additional settings on the other. In the operation of the hearing device, both training procedures run in particular simultaneously. Essentially, the combination of the first and second training procedures thus simply corresponds to a modified, passive form of training. Since in this approach additional settings are fed in without prompting, this form of training is also called "injected learning". As feedback from the user is not actively requested even when other settings are included as well, this training remains essentially passive.

In a preferred embodiment the second training procedure of the learning machine is also passive, since no feedback is actively elicited from the user. Accordingly, as with the first training procedure, feedback from the user is not actively requested during the second training run either, rather it is already sufficient that the other setting can be rated. The user can therefore rate this other setting, but does not have to do so. In other words, feedback from the user is treated as dissatisfaction with the current setting, and a satisfaction of the user with the current setting is assumed as long as no feedback is given. Preferably, the same mechanism as used for the first training is used to rate the other setting. In any case, the learning machine thus treats a feedback as dissatisfaction with the setting immediately before the feedback or at the time of the feedback, and not as satisfaction with the setting immediately after the feedback, if the user has changed the setting as part of the feedback.

Advantageously and, in particular, essentially independently of the second training, the learning machine increases a rating of a setting if the user is satisfied with this setting and reduces the rating if the user is dissatisfied with it. This concept is based on the idea of storing the fitness for purpose of the individual settings in the form of a rating, in order then to select the optimal setting in the situation-dependent setting of the parameter in the operation of the hearing device. If the environment situation changes, the new environment situation is detected and then the setting that has the highest rating for this environment situation is selected. If the environment situation remains the same, other settings, which in principle are rated worse, are set and therefore tested. The user can then use a negative feedback to rate an initially poorly rated setting as actually worse. In a suitable extension, if no feedback is given, a satisfaction with the lower-rated setting is assumed and its rating is then increased.

Preferably, and in principle independently of the second training, in particular, the learning machine automatically assumes a satisfaction of the user with the current setting if no feedback has been received over a certain period of time. This approach supports the general passive approach taken in the training. Regardless of this, a generally advantageous embodiment is one in which a feedback response that comprises a change of the parameter by the user is treated as satisfaction with the new setting chosen by the user. However, this is not absolutely essential and in any case it still requires feedback from the user in order to generate a positive rating, i.e. to increase the rating of a setting. On the other hand, the automatic assumption of user satisfaction after a certain period of time without the user changing the setting allows a positive rating without active user interaction, thereby further improving the convergence of the training procedure. The period of time that is allowed to elapse before satisfaction with the current setting is assumed is preferably between 5 minutes and 15 minutes. Advantageously, the rating of the current setting is then only increased if the environment situation during the period is also the same, i.e. it has not changed.

The other setting, which is presented to the user unprompted within the experimentation-based training, can essentially be selected as desired or at random, but a specific selection is advantageously made. In a suitable embodiment to this end, in the second training procedure the other setting is selected depending on a previous rating of this setting compared to other settings. A suitable embodiment is, for example, one in which a setting is selected which has a lower number of evaluations than the current setting, at least for the current environment situation, in order to then potentially obtain further ratings.

Alternatively or in addition, the other setting is conveniently selected depending on its similarity to the current setting. In a suitable embodiment to this end, in the second training procedure the other setting differs from the current setting by no more than 10%, hence is similar thereto. For example, the parameter is a sound volume and the setting is a value for this volume, which is then varied within a range of +/−10% by the experimentation-based training. In general, by the selection of a similar setting the learning machine advantageously attempts to extend the acceptable range of values for the parameter by testing slightly different settings. If the user expresses dissatisfaction with the new setting via a feedback, this is rated negatively. Otherwise, the new setting is automatically rated as positive, i.e. its rating is increased, particularly after a certain period of time has elapsed, as previously described. In total, this means that other settings, apart from the setting selected depending on the situation at the outset, are tested passively for their suitability without actively requiring user interaction.

Alternatively or in addition, the other setting is conveniently selected depending on its rating by other users. In other words: in a suitable embodiment, in the second training run the other setting is selected depending on a previous rating for this setting by other users. Preferably, the selection is further constrained by only taking into account the evaluations of other users who are similar to the user, e.g. who have a similar audiogram or belong to a similar population group or are of similar age.

In principle, the modified, passive training procedure described can also be combined with an active training. In a suitable embodiment, in a third training procedure, the learning machine is then also actively trained, by eliciting feedback from the user to rate the current setting. The active training procedure is performed in a time-dependent or situation-dependent manner, or initiated by the user him/herself. For example, the active training is performed at certain times or after a certain time interval has elapsed or when the environment situation has changed. However, the modified, passive training reduces the need for active training, so that it is performed much less often.

In a preferred embodiment the feedback of the user consists of the user changing the parameter, for example manually. For this purpose, the hearing device, or an auxiliary device connected to the hearing device, has an input element as described above. By means of the input element, the parameter can be set by the user him/herself, i.e. can be set manually, in contrast to the automatic situation-dependent setting. In case of dissatisfaction with the setting, the user can therefore change the parameter and thus its setting. This is then treated by the learning machine as dissatisfaction with the setting that was applied immediately before the feedback, and its rating is reduced accordingly. The feedback then causes a new setting to be applied. In an advantageous extension, it is assumed that this new setting is satisfactory for the user, since the user has clearly specifically chosen this setting, i.e. a satisfaction with the new setting is assumed and its rating increased accordingly.

The feedback advantageously contains one of the following actions by the user: changing the volume of the hearing device, changing a program of the hearing device, changing the focus of the hearing device. In addition, further actions are also conceivable and suitable.

Preferably, the first and the second training procedures are carried out during the normal operation of the hearing device, i.e. while the hearing device is being worn and used by the user, and not just in a fitting session with the audiologist or in a special training situation. The modified, passive training of the learning machine is preferably carried out online during the operation of the hearing device.

For example, the learning machine is a neural network, a support vector machine, or similar. The learning machine is appropriately configured as an integrated circuit, in particular based on software engineering, e.g. as a microcontroller, or in electrical circuit technology, e.g. as an ASIC. Preferably, the learning machine is integrated into the hearing device, in particular together with the signal processor or as part thereof. Alternatively, another suitable design is one in which the learning machine is relocated to an auxiliary device which is connected to the hearing device, preferably wirelessly.

The object is also achieved independently of the hearing device and the method for its operation, in particular by a learning machine as described above, which is suitable for use with a hearing device as described above.

Other features which are considered as characteristic for the invention are set forth in the appended claims.

Although the invention is illustrated and described herein as embodied in a method for operating a hearing device and to a corresponding hearing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
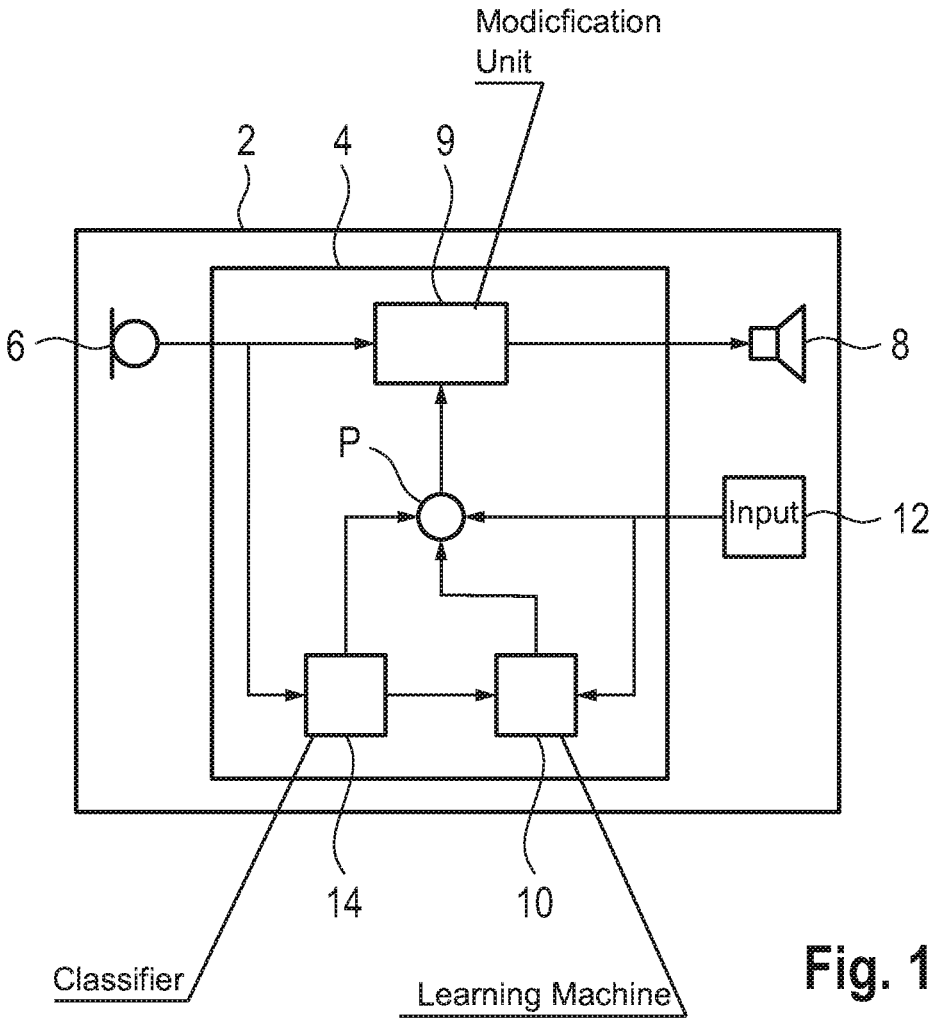
FIG. 1 is a block diagram showing a hearing device according to the invention.

Referring now to the figures of the drawings in detail and first, particularly to FIG. 1 thereof, there is shown a hearing device 2, which has a signal processor 4 having at least one adjustable parameter P, which has a given setting E at a given time, i.e. a specific value for the parameter P, e.g. a specific gain or volume. A user, not shown in detail, of the hearing device 2 wears it in or on the ear when the device is used as intended. The hearing 2 has at least one microphone 6 for receiving ambient sounds, and a receiver 8 for outputting sounds to the user. The microphone 6 generates an electrical input signal from the ambient noise, which is passed on to the signal processor 4 and then modified, e.g. amplified, by the latter depending on the parameter P. This generates a modified input signal which is then an electrical output signal and which is forwarded to the receiver 8 for output. In the present case, the signal processor 4 has a modification unit 9 which modifies the input signal as a function of the parameter P.

Figure 2:
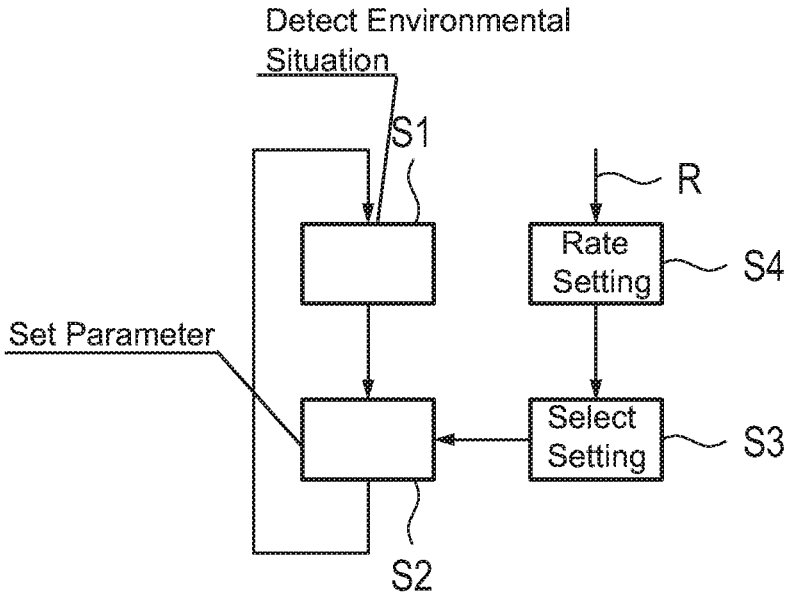
FIG. 2 is a block diagram shows a method for operating the hearing device.

In the method for operating the hearing device 2 a parameter P is set according to the situation by selecting the most suitable possible setting E for the parameter P as a function of the current environment situation and using a learning machine 10. This is carried out repeatedly and automatically by the signal processor 4 and as part of the operation of the hearing device 2. In addition, the parameter P in this case is also manually adjustable by the user via an input element 12. FIG. 2 shows an exemplary embodiment of the method. For the situation-dependent setting, in a first step S1 the current environment situation is first detected. The environment situation is assigned a specific setting E according to an assignment rule, which is then selected in a second step S2 so that the parameter P is set accordingly.

In step S1, the environment situation is detected by means of a classifier 14 of the learning machine 10. The classifier 14 analyzes the input signal generated by the microphone and assigns a class to the current environment situation. Depending on the class, the parameter P is then set in the second step S2. By means of the learning machine 10, the hearing device 2 learns over time which setting E is most suitable in which environment situation and then selects that setting. The learning takes place in a third step S3 in parallel with the two steps S1 and S2 and influences the selection of the setting E for the parameter P in the second step S2, as shown in FIG. 2. The particular setting E is therefore not assigned statically to a particular environment situation in the present case, but is adjusted dynamically by the learning machine 10.

A current setting E of the parameter P can be rated by feedback R of a user of the hearing device 2. The current setting E is the setting E which is set at the current time. In a fourth step S4, the user can rate this setting E by means of feedback R. The feedback R generally comprises an instruction or request from the user to the hearing device 2 to change the current setting E. The feedback R is provided in the present case via the input element 12 of the hearing device 2, e.g. a button for manual input or a microphone, e.g. the microphone 6, for speech input, or another type of sensor for acquiring a user input. The user expresses his/her satisfaction with the current setting E via the feedback R. A rating is then assigned to a particular setting E of the parameter P, e.g. in the form of a counter. The rating is then changed depending on the feedback R and indicates the satisfaction of the user with a respective setting E for the assigned environment situation.

The method contains a learning procedure for the learning machine 10. An exemplary embodiment of this method is explained below with reference to FIG. 3. In a first training procedure the learning machine 10 is passively trained using negative feedback R, by feedback R from the user being rated in step B− as dissatisfaction with the current setting E, and by assuming in step B+ the user to be satisfied with the current setting E as long as no feedback R is given. No feedback R from the user is explicitly elicited or requested, but voluntarily provided feedback R from the user is used instead.

In addition, in the exemplary embodiment shown, in a second training procedure the learning machine 10 is additionally trained by changing, in a fifth step S5, the current setting E independently of feedback R from the user and in spite of an assumed satisfaction with the current setting E, so that the user is offered a different setting E which can then be appropriately rated by feedback R. Based on the first, passive training procedure, the user is thus offered different settings E unprompted, in order to obtain additional ratings for these settings E in steps B−, B+, although the current setting E itself is assumed to be satisfactory. The current setting E of the parameter P is therefore changed under a constant environment situation to test different settings E for the same environment situation, i.e. the learning machine 10 experiments with different settings E, so that the second training is also called experimentation-based training. The experimentation-based training using the fifth step S5 will potentially provoke additional feedback responses R and thus then potentially generate additional ratings in steps B−, B+, but in doing so the advantage of a passive training is retained, namely the reduced user interaction compared to active training.

In the present case the second training procedure of the learning machine 10 is also passive, by virtue of no feedback R being actively elicited from the user. Therefore, even during the second training procedure, feedback R is not actively requested from the user, rather it is sufficient that the other setting E can be rated. The user can rate this other setting E, but does not have to do so. In this case, even the same mechanism is used for the rating as for the first training. In any case, the learning machine 10 therefore rates a feedback R as dissatisfaction with the setting immediately before the feedback R or at the time of the feedback R, and not as satisfaction with the setting immediately after the feedback R, if the user has changed the setting E as part of the feedback R.

Overall, if the user is satisfied with a setting E the learning machine 10 increases a rating of this setting E, and decreases it if the user is dissatisfied. As a result the fitness for purpose of the individual settings E is stored in the form of a set of ratings, in order then to select the optimal setting E in the situation-dependent setting of the parameter P in the second step S2. If the environment situation changes, the new environment situation is detected and the setting E which has the highest rating for this environment situation is then selected. If the environment situation remains the same, other settings E, which in principle are rated as worse, are set and therefore tested.

In the present case the learning machine 10 automatically assumes the user's satisfaction with the current setting E if no feedback R has been provided over a certain period of time t. This is also the case in the exemplary embodiment of FIG. 3. The automatic assumption of the user's satisfaction after a certain period of time t without the user changing the setting E allows a positive rating without active user interaction. For example, the time period t that is allowed to elapse is between 5 minutes and 15 minutes.

The other setting E, which is presented to the user unprompted within the experimentation-based training, can essentially be selected as desired or at random, but a specific selection is made in this case. The other setting E in this case is selected depending on a previous rating of this setting E compared to other settings E. For example, a setting E is selected that has a lower number of ratings at least for the current environment situation than the current setting E, in order then to potentially obtain further ratings.

Alternatively or in addition, the other setting E is selected as a function of its similarity to the current setting E and differs from the current setting E by no more than 10%, for example, hence is similar thereto. For example, the parameter P is a sound volume and the setting E a value for this volume, which is then varied within a range of +/−10% by the experimentation-based training.

Alternatively or in addition, the other setting E is selected as a function of its rating by other users. In an exemplary extension, the selection is further constrained by only taking into account the evaluations of such other users who are similar to the user, e.g. who have a similar audiogram or belong to a similar population group or are of similar age.

Apart from the exemplary embodiment shown with purely modified passive training, in one variant this is combined with an active training procedure. In a third training procedure the learning machine 10 is then additionally actively trained by eliciting feedback R from the user to rate the current setting E. The active training procedure is performed in a time-dependent or situation-dependent manner, or initiated by the user him/herself. For example, the active training is performed at certain times or after a certain time interval has elapsed, or when the environment situation has changed.

Figure 3:
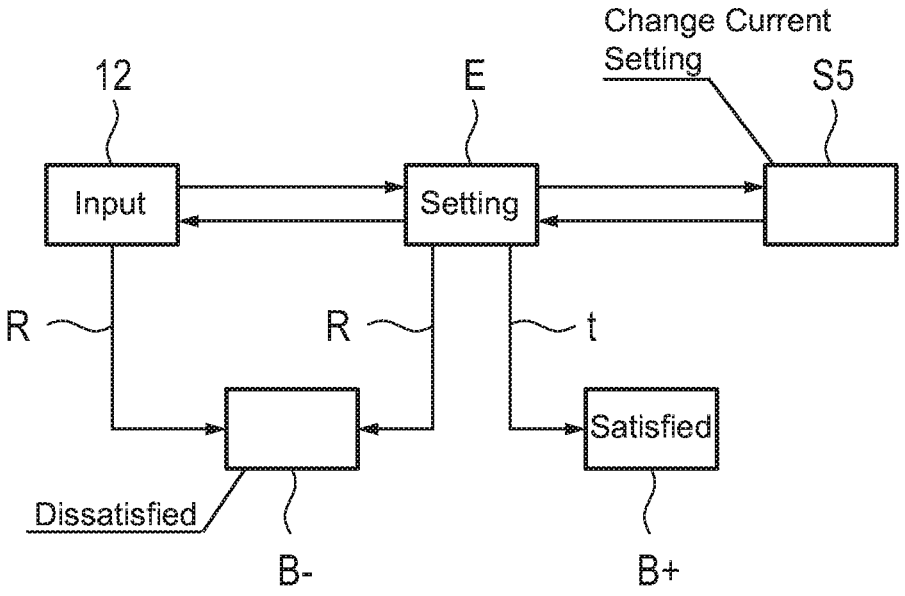
FIG. 3 is a block diagram showing a training procedure of a training machine.

The feedback E of the user in this case consists of the user manually changing the parameter P using the input element 12. In a variant not shown, the input element 12 is not a part of the hearing device 2 as shown in FIG. 1, but a part of an auxiliary device connected to the hearing device 2 for data transfer. The auxiliary device is e.g. a remote control for the hearing device 2, or a smartphone or similar. The manual setting E of the parameter P by means of the input element 12 is also shown in FIG. 3. In case of dissatisfaction with the setting E, the user can thereby change the parameter P. This is then treated by the learning machine 10 as dissatisfaction with the setting E that was applied immediately before the feedback R, and its rating is reduced accordingly in step B−. The feedback signal R is then used to set a new setting E. In an extension, it is additionally assumed that this new setting E is satisfactory to the user, since the user has clearly specifically chosen this setting E, i.e. a satisfaction with the new setting E is assumed and its rating is increased accordingly in a step B+. This variant is not explicitly shown in FIG. 3.

The feedback R comprises, for example, one of the following actions on the part of the user: changing the volume of the hearing device 2, changing a program of the hearing device 2, changing the focus of the hearing device 2. In addition, further actions are also conceivable and appropriate.

For example, the learning machine 10 is a neural network, a support vector machine, or similar. The learning machine 10 in this case is designed as an integrated circuit, e.g. based on software engineering as a microcontroller, or in electrical circuit technology as an ASIC. In this case, the learning machine 10 is integrated into the hearing device 2, in the exemplary embodiment shown even as part of the signal processor 4. Alternatively, in another suitable arrangement, not shown, the learning machine 10 is relocated to an auxiliary device, e.g. as described above, which is connected to the hearing device 2, e.g. wirelessly.

The various aspects described above and shown in FIGS. 1-3 can in principle also be implemented independently of each other and in principle can also be combined as desired, thus also resulting in further exemplary embodiments.

The following is a summary list of reference numerals and the corresponding structure used in the above description of the invention:

2 hearing device
4 signal processor
6 microphone
8 receiver
9 modification unit
10 learning machine
12 input element
14 classifier
B−, B+ step (for rating)
E setting
P parameter
R feedback
S1 first step
S2 second step
S3 third step
S4 fourth step
S5 fifth step (change of the current setting for second training procedure)
t time interval

The invention claimed is:

1. A method for operating a hearing device having a signal processor with at least one adjustable parameter having a given setting at a given time, which comprises the steps of:

generating the adjustable parameter according to a situation by selecting a setting for the adjustable parameter depending on a current environment situation, by using a learning machine;

rating a current setting of the adjustable parameter rated by feedback of a user of the hearing device;

passively training the learning machine in a first training procedure by use of negative feedback, being the feedback from the user being rated as dissatisfaction with the current setting and by assuming the user to be satisfied with the current setting as long as no said feedback is given; and additionally training the learning machine in a second training procedure by changing the current setting independently of the feedback from the user and in spite of an assumed satisfaction with the current setting, so that the user is offered a different setting which can then be rated by the feedback, wherein the different setting is selected depending on a previous rating of the setting compared to other settings.

2. The method according to claim 1, wherein in an event of user satisfaction with the setting the learning machine increases a rating of the setting, and decreases the rating in an event of user dissatisfaction.

3. The method according to claim 1, wherein the learning machine automatically assumes user satisfaction with the current setting if no said feedback has been issued over a certain period of time.

4. The method according to claim 1, wherein the second training procedure of the learning machine is passive, by not actively eliciting the feedback from the user.

5. The method according to claim 1, wherein in the second training procedure, the different setting differs from the current setting by no more than 10% higher or 10% lower.

6. The method according to claim 1, wherein in the second training procedure, the different setting is selected depending on the previous rating of the setting by other users.

7. The method according to claim 1, which further comprises carrying out the first and the second training procedure during normal operation of the hearing device.

8. The method according to claim 1, which further comprises actively training the learning machine in a third training procedure by eliciting the feedback from the user to rate the current setting.

9. The method according to claim 1, wherein the feedback consists of the user changing the adjustable parameter.

10. The method according to claim 1, wherein the feedback includes one of the following actions by the user: changing a volume of the hearing device, changing a program of the hearing device, and changing a focus of the hearing device.

11. The method according to claim 1, wherein the learning machine is integrated into the hearing device.

12. A hearing device, comprising:

a signal processing unit configured to carry out a method according to claim 1.

* * * * *